United States Patent [19]

Devine

[11] 4,124,542

[45] Nov. 7, 1978

[54] SPOT CLEANING COMPOSITION FOR CARPETS AND THE LIKE

[76] Inventor: Michael J. Devine, 9328 Kessler La., Overland Park, Kans. 66212

[21] Appl. No.: 827,799

[22] Filed: Aug. 25, 1977

[51] Int. Cl.[2] ..... C11D 3/44; C11D 7/50

[52] U.S. Cl. ..... 252/546; 252/153; 252/170; 252/543; 252/545; 252/550; 252/DIG. 14

[58] Field of Search ..... 252/153, 170, 546, 550, 252/DIG. 11, DIG. 14, 90

[56] References Cited

U.S. PATENT DOCUMENTS

| | | | |
|---|---|---|---|
| 3,497,456 | 2/1970 | Goodell | 252/153 |
| 3,607,760 | 9/1971 | McIntyre | 252/104 |
| 3,748,268 | 7/1973 | Loudas | 252/90 |
| 3,764,544 | 10/1973 | Haworth | 252/170 |
| 3,779,929 | 12/1973 | Abler et al. | 252/90 |
| 3,872,021 | 3/1975 | McKnight | 252/121 |
| 4,013,595 | 3/1977 | Podella et al. | 252/545 |

FOREIGN PATENT DOCUMENTS 528,747 5/1954 Belgium.

*Primary Examiner*—P.E. Willis, Jr.
*Attorney, Agent, or Firm*—Schmidt, Johnson, Hovey & Williams

[57] ABSTRACT

A cleaning composition especially useful for carpet cleaning and spotting is provided which gives results heretofore unobtainable with prior compositions. The composition hereof is capable of removing a virtually unlimited variety of carpet stains and the like which have heretofore required a large number of specialized cleaning agents. The composition preferably includes respective amounts of ammonium lauryl sulfate 2-butoxyethanol, mineral spirits, isopropanol, sodium ethylenediaminetetraacetic acid and an optical brightening agent.

6 Claims, No Drawings

SPOT CLEANING COMPOSITION FOR CARPETS AND THE LIKE

The present invention relates to novel cleaning compositions which are especially adapted for use in cleaning carpets but which can also be utilized as needed in other contexts. More particularly, it is concerned with an aqueous cleaning composition which is characterized by the ability to remove a wide variety of common household stains from carpets and the like.

A large number of carpet cleaning compositions have been proposed in the past. Although some of these compositions have achieved notable success, a number of unresolved problems remain in connection therewith. First of all, many of these compositions lack the ability to effectively remove a broad range of carpet stains encountered in practic. This problem has led many commercial carpet cleaners to stock a wide variety of cleaning agents for use in removing specific stains. As can be appreciated, this is not only a costly proposition from the standpoint of purchasing and storing the specialized cleaning agents, but also can cause significant losses by virtue of the fact that cleaning personnel must spend extra time in treating difficult stains which require such specialized agents.

It is therefore the most important object of the present invention to provide an easily usable liquid cleaning composition especially adapted for use in cleaning carpets which is characterized by the capability of removing a virtually unlimited number of stains encountered in practice, so that the problems encountered with prior cleaning compositions are in large measure alleviated.

As a corollary to the foregoing, another object of the invention is to provide a cleaning composition which preferably includes respective quantities of ammonium lauryl sulfate, 2-butoxyethanol, mineral spirits, isopropanol, sodium ethylenediaminetetraacetic acid admixed in water to yield a synergistically active composition; optionally, further ingredients such as an optical brightener, and odor-giving and coloring agents can also be employed.

Turning now to the detailed aspects of the invention, the compositions hereof have active ingredients dispersed in water. These active ingredients preferably include, on an approximate volume basis:

TABLE I

| Active Ingredients | Parts (by volume) |
|---|---|
| ammonium lauryl sulfate | 6 - 10 |
| [1]loweralkoxymonohydricloweralcohol | 0.5 - 5 |
| mineral spirits | 0.25 - 3 |
| [2]lowermonohydric alcohol | 0.01 - 0.5 |
| [3]alkali metal salt of EDTA | 0.005 - 0.10 |

[1]"loweralkoxy" and "loweralcohol" respectively refer to alkoxy and alcohol moieties having from 1 to 4 carbon atoms, inclusive
[2]Refers to alcohols having from 1 to 4 carbon atoms, inclusive
[3]Salts of ethylenediaminetetraacetic acid such as sodium EDTA In preferred forms of the invention, an odor-giving agent such as liquid lemon odor or the like can be added to the compositions in order to impart desired odor characteristics thereto. Of course, any other odor-giving agent compatible with the cleaning composition could also be used. Likewise minor amounts of chemical brighteners and/or coloring agents can also be employed.

In the most preferred embodiment, a particularly effective concentrated cleaning composition has been found to comprise the following constituents, for a 5 gallon batch:

TABLE II

| Constituents | [1]Parts |
|---|---|
| ammonium lauryl sulfate | 1 gallon |
| 2-butoxyethanol | 1 quart |
| mineral spirits | 1⅓ pints |
| isopropanol | 1 ounce |
| sodium EDTA | ½ ounce |
| [2]aminocoumarin | ⅛ ounce |
| water | to 5 gallons |

[1]Data given in parts by volume on an approximate basis.
[2]The active ingredient in an optical brightener sold by the G.A.F. Company of New York, N. Y. under the designation Blancophor CN.

This concentrate is made simply by thoroughly mixing the listed constituents in an appropriate container. In practice, the concentrate is diluted to a level of 9 parts water, 1 part concentrate prior to use. The resulting product can then be bottled for home use or shipped in bulk to professional carpet cleaners. Also, odor-giving and coloring agents may also be added thereto if desired.

In carpet cleaning operations, the compositions hereof are capable of removing a virtually unlimited number of stains. For example, the composition has been found to be effective in removing stains from carbonated beverages, fruit juices, alcoholic beverages, coffee, tea, milk, wine, jelly, jam and other condiments. In addition, oil based stains such as butter, margarine, grease, lard, salad oil and the like can also be easily and quickly removed with the present composition. Spot cleaning of carpets and the like can be effected without specific knowledge of the type of stain and without fear of producing an unsightly "ring" on the cleaned surface. Finally, stains which have been "set" by earlier cleaning attempts with conventional cleaning agents can also be removed without difficulty with the present compositions.

Having thus described the invention, what is claimed as new and desired to be secured by Letters Patent is:

1. An aqueous carpet cleaning composition having active ingredients dispersed in water, said active ingredients comprising on a volume basis:
   - from about 6 to 10 parts of ammonium lauryl sulfate;
   - from about 0.5 to 5 parts of a loweralkoxymonohydricloweralcohol;
   - from about 0.25 to 3 parts of mineral spirits;
   - from about 0.01 to 0.5 parts of a lowermonohydricalcohol; and
   - a minor amount of an alkali metal salt of ethylenediaminetetraacetic acid.

2. The carpet cleaning composition of claim 1 wherein said active ingredients also include an optical brightener.

3. The carpet cleaning composition of claim 1 wherein said loweralkoxymonohydricloweralcohol is 2-butoxyethanol.

4. The carpet cleaning composition of claim 1 wherein said lowermonohydricalcohol is isopropanol.

5. The carpet cleaning composition of claim 1 wherein said salt is sodium ethylenediaminetetraacetic acid.

6. The carpet cleaning composition of claim 1 wherein, for a 5 gallon batch, said active ingredients comprise on a volume basis:
   - about 1 gallon of ammonium lauryl sulfate;
   - about 1 quart of 2-butoxyethanol;
   - about 1⅓pints of mineral spirits;
   - about 1 ounce of isopropanol;
   - about ½ ounce of sodium ethylenediaminetetraacetic acid; and
   - about ⅛ ounce of aminocoumarin.

* * * * *